US005288135A

United States Patent [19]

Forcier et al.

[11] Patent Number: 5,288,135

[45] Date of Patent: Feb. 22, 1994

[54] LUMBAR SUPPORTING SEAT CUSHION

[76] Inventors: Robert A. Forcier; Marsha M. Forcier, both of 2448 N. Rose St., Mesa, Ariz. 85213

[21] Appl. No.: 884,163

[22] Filed: May 18, 1992

[51] Int. Cl.[5] ..... A47C 7/02; A47C 27/08; A47K 11/04

[52] U.S. Cl. ..... 297/452.21; 297/452.3; 297/DIG. 4; 5/653; 4/479; 4/480

[58] Field of Search ..... 297/458, 459, 460, 456, 297/DIG. 4; 5/653, 654; 4/479, 480

[56] References Cited

U.S. PATENT DOCUMENTS

| | | | |
|---|---|---|---|
| 2,855,986 | 10/1958 | Engelen, Sr. | 297/460 |
| 3,167,351 | 1/1965 | Butler | 297/42 |
| 3,205,010 | 9/1965 | Schick | 297/460 |
| 3,749,442 | 7/1973 | Berg et al. | 297/312 |
| 3,890,004 | 6/1975 | Rail | 297/423 |
| 4,300,219 | 11/1981 | Taylor | 4/661 |
| 4,643,481 | 2/1987 | Saloff et al. | 5/653 |
| 4,753,482 | 6/1988 | Warren | 297/458 |
| 4,824,169 | 4/1989 | Jarrell | 297/230 |
| 4,912,788 | 4/1990 | Lonardo | 5/432 |
| 4,951,334 | 8/1990 | Maier | 5/653 |

FOREIGN PATENT DOCUMENTS

| | | | |
|---|---|---|---|
| 1273761 | 7/1968 | Fed. Rep. of Germany | 297/456 |

*Primary Examiner*—Alexander Grosz
*Attorney, Agent, or Firm*—Jordan M. Meschkow; Lowell W. Gresham; Don J. Flickinger

[57] ABSTRACT

A seat cushion for prolonged sitting, having a thigh cushion coupled to and spaced apart from a back cushion. A seat well is defined between the thigh cushion and the back cushion to remove pressure from the buttocks region. Coupling members couple the thigh cushion and the back cushion, and extend there between on either side of the seat well.

8 Claims, 1 Drawing Sheet

LUMBAR SUPPORTING SEAT CUSHION

BACKGROUND OF THE INVENTION

1. Field of the Invention

This invention relates to cushion support apparatus.

More particularly, the present invention relates to seating devices which support various parts of the body and reduce pressure exerted on other parts.

In a further and more specific aspect, the present invention concerns providing a supporting cushion for persons unable to control their evacuative functions, and the removal of waste resulting from their incontinence.

2. Prior Art

Persons who remain seated for extended periods of time or who have a long term immobility which confines them to a wheelchair are highly susceptible to pressure related problems such as decubitus ulcers. These ulcers generally occur on bony portions of the body where the tissue covering is relatively thin. Decubitus ulcers result from prolonged pressure on the thin body tissues which cause reduced blood flow to those tissues.

In the prior art, seating devices have been developed which attempt to minimize the pressure on body prominences. These prior art cushions include softer foam, gels, doughnut inflatable ring, and geometries which remove cushion material in areas directly associated with these prominences. While these prior art cushions may have some success in reducing pressures to the sensitive areas, many do not provide back support in combination with the pressure reducing means. Prior art cushions rely on a very delicate balance of the front legs acting as levers, the cushions providing the fulcrum for the lever and the rear portion of the cushion providing a very soft pressure Without back support, this lever mechanism does not always work and may result in excessive back pressure Also, since many of the prior art cushions require mechanical contact with the most sensitive areas, moisture and heat build up naturally occurs and may result in accelerated tissue break down problems with extensive use.

It would be highly advantageous, therefore, to remedy the foregoing and other deficiencies inherent in the prior art.

Accordingly, it is an object of the present invention to provide a new and improved seat cushion.

Another object of the present invention is to provide a seat cushion which can be used on a wide variety of seating devices such as chairs and wheelchairs.

A further object of the present invention is to provide a seat cushion which will eleviate pressure related problems to the buttocks area.

And another object of the present invention is to provide a seat cushion which distributes the body weight over the thighs and back of an individual.

Still another object of the present invention is to provide a seat cushion which supports the lumbar region of the back.

Yet another object of the present invention is to provide a seat cushion which removes all pressure from the buttocks region while still allowing for some lateral movement of an individual.

Yet still another object of the present invention is to provide a seat cushion which allows air movement around the buttocks area, reducing moisture and heat build up.

A further object of the present invention is to provide a seat cushion having a seat well for collecting waste when used by individuals unable to control evacuative functions.

SUMMARY OF THE INVENTION

Briefly, to achieve the desired objects of the instant invention in accordance with a preferred embodiment thereof, provided is a thigh cushion coupled to and spaced apart from a back cushion by coupling members. A seat well is defined between the thigh cushion and the back cushion, and bounded on both sides by coupling members A lumbar support extends from the back cushion, providing correct posture for proper cushion operation. The buttocks area of an individual depends downward into the seat well, supported between the thigh cushion and the lumbar support.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
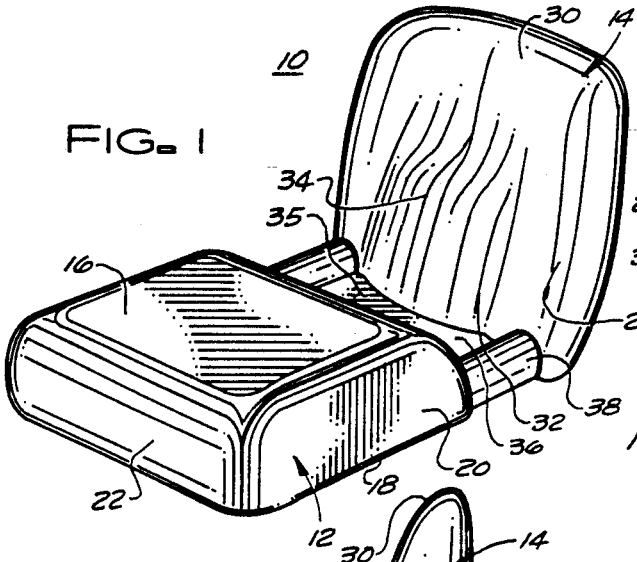
FIG. 1 is a perspective view of a seat cushion, constructed in accordance with the teachings of the instant invention.
Figure 7:
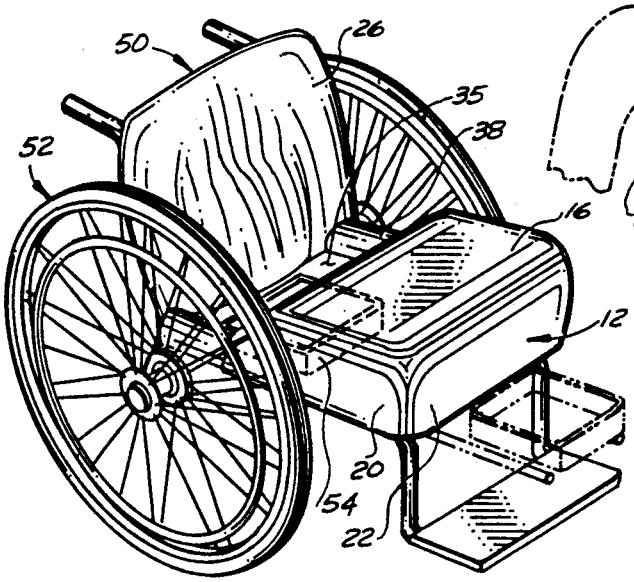
FIG. 7 is a perspective view illustrating an alternate of the seat cushion.

Turning now to the drawings in which like reference characters indicate corresponding elements throughout the several views, attention is first directed to FIG. 1 which illustrates a seat cushion generally designated 10. Seat cushion 10 can be used in a wheelchair, as depicted in FIG. 7, or any other conventional chair. Preferably, seat cushion 10 includes a thigh cushion 12 and a back cushion 14 coupled to thigh cushion 12 in a spaced apart relationship by coupling members. Thigh cushion 12 includes a top wall 16, an opposing bottom wall 18, opposing side walls 20, a front wall 22 and a rear wall 24. Back cushion 14 includes a front surface 26 and opposing back surface 28 a top portion 30 and a bottom portion 32. Front surface 26 of back cushion 14 is contoured to provide support for an individual's lower back. A compression portion 34 extends outward from bottom portion 32, and slopes inwardly at a point located medially between top portion 30 and bottom portion 32. Top portion 30 may be rounded outward on front surface 26, to function as a lumbar support.

Figure 3:
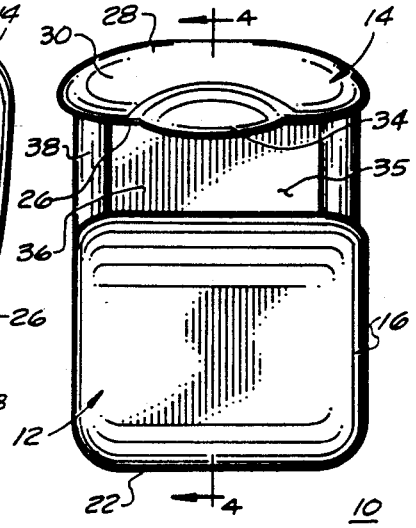
FIG. 3 is a top perspective view of the seat cushion illustrated in FIG. 1.
Figure 2:
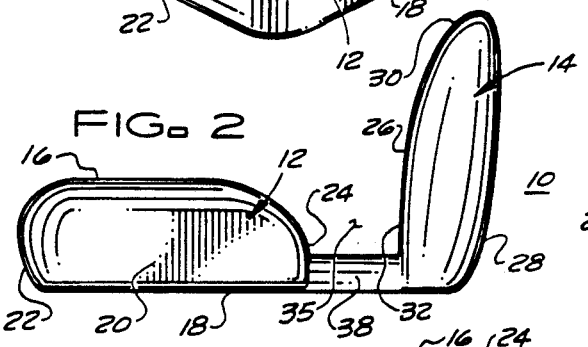
FIG. 2 is a perspective side view of the seat cushion illustrated in FIG. 1.
Figure 4:
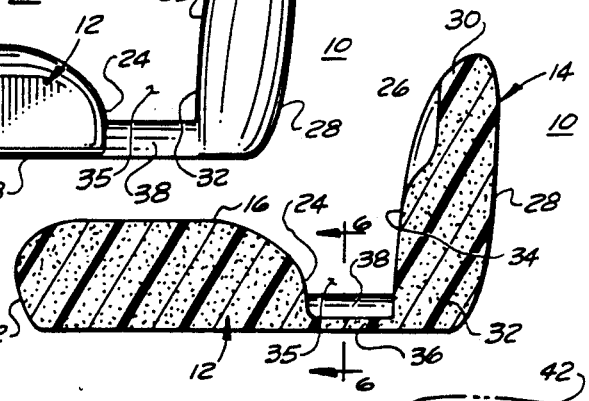
FIG. 4 is a cut away side view taken along line 4—4 of FIG. 3.

A seat well 36 is formed between thigh cushion 12 and back cushion 14 and extends laterally the width of thigh cushion 12 and back cushion 14. As illustrated in FIGS. 1, 3, and 4, a well bottom 36 may extend from bottom wall 18 of thigh cushion 12, and couple to the bottom portion 32 of back cushion 14. Well bottom 36 aides in coupling back cushion 14 to thigh cushion 12. Also, since cushion 10 may be used on substantially any seating device such as a wheelchair or conventional chair, well bottom 36 also helps to protect the underlying support device.

Thigh cushion 12 is coupled to back cushion 14 by coupling members, which may, for example, be a frame extending under bottom wall 18 of thigh cushion 12 and back surface 28 of back cushion 14. While a wide variety of coupling members may be employed to couple thigh cushion 12 to back cushion 14, in the preferred embodiment, padded side ties 38 are used. Side ties 38 are cushions which extend from rear wall 24 of thigh cushion 12 proximate each of side walls 20, and couple to front surface 26 of back cushion 14 proximate bottom portion 32. Side ties 38 extend from thigh cushion 12 to back cushion 14 on both sides of seat well 35. It will be understood by those skilled in the art that other coupling members may be employed, as long as they extend between thigh cushion 12 and back cushion 14 without obstructing seat well 35.

Figure 5:
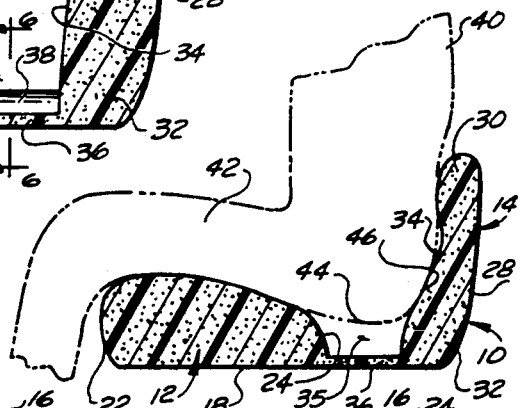
FIG. 5 is a cut away side view similar to the view known in FIG. 4, in use by an individual illustrated by broken lines.
Figure 6:
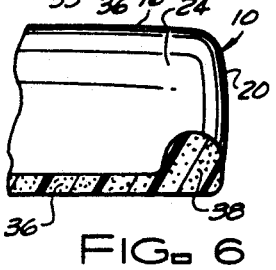
FIG. 6 is a partial cut away view taken along line 6—6 of FIG. 4.

Referring now to FIG. 5, an individual illustrated by broken lines 40 is shown seated on seat cushion 10. Seat cushion 10 provides three point suspension, utilizing a lumbar support area in back cushion 14, and thigh support areas in thigh cushion 12. An individual's thighs 42 are supported by thigh cushion 12, allowing the buttocks region 44 to depend downward into seat well 35. A tail bone area 46 of an individual 40 presses against and compresses compression portion 34. Compression portion 34, together with top portion 30 of back cushion 14, which acts as a lumbar support, provides the third suspension point. The three point suspension together with seat well 35 provides substantially zero pressure in the buttocks region, eliminating pressure related problems, and increasing air circulation to reduce heat and moisture build-up. Seat cushion 10 will generally be used with a support structure such as a chair, which will have a back extending upwardly behind back cushion 14. This back (not shown) will typically extend upward past back cushion 14, supporting the upper back and shoulders of individual 40.

Referring now to FIG. 7, a second embodiment generally designated 50 is illustrated. In this embodiment, seat cushion 50 is substantially identical to seat cushion 10, with the exception of well bottom 36 being absent. Since an individual's buttocks depend downward into seat well 35, and ideally does not contact well bottom 36, this element may be eliminated. With the elimination of well bottom 36, embodiment 50 can be used in combination with a wheelchair frame 52. A waste tray 54 can then be removably installed under seat cushion 50 positioned centrally of seat well 35. This configuration of seat cushion 50 will allow attendants caring for seat bound individuals who cannot control their excrementary functions, to keep the chair and chair bound individual clean. Waste from the chair bound individual will drop through seat well 35 instead of being caught between the individual and a seat cushion. The attendant can then remove the waste simply by removing waste tray 54. The chair bound individual may wear a backless gown for modesty purposes, or similar garments which leave the buttocks area uncovered. Incontinent women could employ seat cushion 50 with seat well 35 alone, while incontinent men may require the additional use of a urinary drainage apparatus which could terminate in waste tray 54.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A supporting seat cushion, adapted to substantially reduce pressure on a user's buttocks region, comprising:
   a generally horizontal thigh supporting cushion having a top surface and an opposing bottom surface;
   a back supporting cushion having a front surface and an opposing back surface, with said front surface comprising a compression portion extending outwardly therefrom; coupling members extending between and coupling said thigh supporting cushion and said back supporting cushion; and a seat well defined between said thigh supporting cushion and said back supporting cushion, said seat cushion dimensioned such that a user's thighs are supported on the thigh supporting cushion, a user's lower back area presses against and compresses the compression portion of the back supporting cushion, and a user's buttocks region depends downwardly into the seat well.

2. A seat cushion as claimed in claim 1 further comprising a well bottom extending from a bottom portion of said thigh cushion under said seat well and coupled to a lower portion of said back cushion.

3. A seat cushion as claimed in claim 1 wherein said back cushion further comprises a front portion configured for lumbar support.

4. The supporting seat cushion of claim 1 further including a base supporting said cushion to form a chair.

5. A supporting seat cushion, adapted to substantially reduce pressure on a user's buttocks region, in combination with a support structure, comprising:
   a generally horizontal thigh supporting cushion having a top surface and an opposing bottom surface;
   a back supporting cushion having a front surface and an opposing back surface, with said front surface comprising a compression portion extending outwardly therefrom; coupling members extending between and coupling said thigh supporting cushion and said back supporting cushion; and a seat well defined between said thigh supporting cushion and said back supporting cushion, said seat cushion dimensioned such that a user's thighs are supported on the thigh supporting cushion, a user's lower back area presses against and compresses the compression portion of the back supporting cushion, and a user's buttocks region depends downwardly into the seat well.

6. A seating device as claimed in claim 5 wherein said support structure further comprises:
   a substantially vertical back;
   a substantially horizontal seat coupled to said back;
   a waste opening in said horizontal seat corresponding to said seat well of said seat cushion; and
   a waste container removably coupled to the underside of said horizontal seat aligned with said waste opening and said seat well.

7. A seating device as claimed in claim 5 wherein said support structure is a chair.

8. A seating device as claimed in claim 5 wherein said support structure is a wheelchair.

* * * * *